US006966077B2

(12) United States Patent
Cho

(10) Patent No.: US 6,966,077 B2
(45) Date of Patent: Nov. 22, 2005

(54) APPARATUS FOR AUTOMATICALLY OPERATING A DRAIN VALVE IN A WASHSTAND

(76) Inventor: Sang-Ik Cho, SK Apt. 4-1401, 163 Ingye-Dong, Paldal-Gu, Suwon Gyeonggi-Do (KR) 442-826

( * ) Notice: Subject to any disclaimer, the term of this patent is extended or adjusted under 35 U.S.C. 154(b) by 0 days.

(21) Appl. No.: 10/773,798

(22) Filed: Feb. 6, 2004

(65) Prior Publication Data

US 2005/0060796 A1 Mar. 24, 2005

(30) Foreign Application Priority Data

Sep. 19, 2003 (KR) ..... 10-2003-0064988

(51) Int. Cl.[7] ..... A47K 1/14
(52) U.S. Cl. ..... 4/295; 4/293; 4/693; 4/688
(58) Field of Search ..... 4/688–693, 286, 4/287, 293, 405

(56) References Cited

U.S. PATENT DOCUMENTS 3,965,492 A * 6/1976 Hendricks ..... 4/422
4,508,143 A * 4/1985 Ogasawara ..... 137/636.1
5,048,556 A * 9/1991 Grumelot et al. ..... 137/270

FOREIGN PATENT DOCUMENTS

JP 10212747 A * 8/1998 ..... A47K 1/14

* cited by examiner

*Primary Examiner*—Khoa D. Huynh
(74) *Attorney, Agent, or Firm*—Ladas & Parry LLP

(57) ABSTRACT

Disclosed is an apparatus for opening and shutting a drain valve in a washstand, particularly, an apparatus for automatically opening and shutting a drain valve in a washstand, wherein an automatic opening and shutting means for automatically opening and shutting the drain valve is mounted. The apparatus for automatically opening and shutting the drain valve in the washstand, wherein a drain-pipe is connected to the bottom of a washstand, and the top of the drain-pipe, i.e., a drain-outlet is opened and shut by a drain valve built in the drain-pipe, including a deceleration motor formed at one side of the drain-pipe, a working cam closely contacting the bottom of the drain valve, wherein the working cam is disposed on the axis of the deceleration motor, and a touch button for turning on/off the deceleration motor, wherein the touch button is disposed at a predetermined portion of the washstand.

4 Claims, 3 Drawing Sheets

APPARATUS FOR AUTOMATICALLY OPERATING A DRAIN VALVE IN A WASHSTAND

BACKGROUND OF THE INVENTION

1. Field of the Invention

The present invention relates to an apparatus for opening and shutting a drain valve in a washstand, and more specifically, to an apparatus for automatically opening and shutting a drain valve in a washstand, wherein an automatic opening and shutting means for automatically opening and shutting the drain valve is mounted.

2. Discussion of Related Art

As noted well, a drain-outlet of a washstand must be equipped with a drain valve for opening and shutting the drain-outlet. Furthermore, as the drain valve is opened and shut by an opening and shutting apparatus, water is contained in a washstand and used water is drained through the drain valve.

A conventional valve opening and shutting apparatus includes a connection link 2 linked to the bottom of a stem 1*a* in a valve 1, and a working rod 4 whose bottom is linked to the connection link 2 and whose top is exposed outside of a washstand 3, as shown in FIG. 1.

Therefore, if the working rod 4 is pulled upwardly, the connection link 2 linked to the bottom of the working rod 4 pulls downwardly the valve 1 that is put on, while seesawing with a through-hole 5*a* of a drain-pipe 5 as its a starting point, thus shutting the upper side of the drain-pipe 5, i.e., a drain-outlet 5*b*.

On the contrary, if the working rod 4 that is put on is pressed downwardly, the connection link 2 linked to the bottom of the working rod 4 pushes upwardly the valve 1 that is put down, while seesawing with the through-hole 5*a* portion of the drain-pipe 5 as its a starting point, thus opening the drain-pipe 5.

As this kind of the conventional valve opening and shutting apparatus is a manual type, it is inconvenient to manipulate the valve. In particular, if the valve 1 is to be shut, it is required that the working rod 4 be pulled up strongly so that the drain-outlet 5*b* is shut, as described above. In case of the old and weak and children, the washstand is used in a state where the valve is not fully shut since they have a weak strength to pull up the working rod. This causes large amounts of water to be wasted.

Furthermore, as the working rod 4 has to be installed passing through the washstand 3 outwardly, a through-hole 3*a* through which the working rod 4 goes must be formed when manufacturing the washstand. This makes the manufacturing process difficult.

In addition, as the working rod 4 is protruded outside of the washstand 3, there is danger of an injury or a wound of the hands due to hit to the working rod. Also it is not good in terms of sanitation and a fine view since alien substances such as fur are stuck around the working rod.

SUMMARY OF THE INVENTION

Accordingly, the present invention has been made in view of the above problems, and it is a main object of the present invention to provide an apparatus for automatically opening and shutting a drain valve in a washstand, wherein the drain valve is automatically opened and shut.

As such, as the drain valve is automatically opened and shut, it is possible to secure convenience of use. It is also possible to simplify the process of manufacturing a washstand since a working rod is not necessary. Furthermore, it is possible to obviate danger of an injury or a wound and to improve poor sanitation/fine view problems, which are generated by the working rod.

To achieve the above object, according to the present invention, there is provided an apparatus for automatically opening and shutting a drain valve in a washstand, wherein a drain-pipe is connected to the bottom of a washstand, and the top of the drain-pipe, i.e., a drain-outlet is opened and shut by a drain valve built in the drain-pipe, comprising a deceleration motor formed at one side of the drain-pipe, a working cam closely contacting the bottom of the drain valve, wherein the working cam is disposed on the axis of the deceleration motor, and a touch button for turning on/off the deceleration motor, wherein the touch button is disposed at a predetermined portion of the washstand.

Furthermore, the drain-pipe is divided into an upper drain-pipe and a lower drain-pipe, wherein the upper drain-pipe and the lower drain-pipe are combined each other, upper and lower spring housings are built in the upper drain-pipe and the lower drain-pipe, respectively, wherein the upper and lower spring housings are combined each other with them disposed oppositely, a spring for resiliently supporting the drain valve in a working direction is disposed within the upper and lower spring housings.

DETAILED DESCRIPTION OF THE PREFERRED EMBODIMENTS

Now the preferred embodiments according to the present invention will be described with reference to the accompanying drawings.

Figure 1:
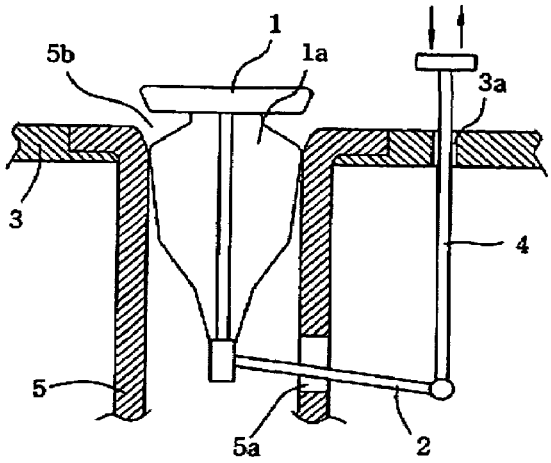
Fig. 1 (Prior Art)
FIG. 1 is a view illustrating the construction of a drain valve opening/shutting apparatus for a washstand according to a prior art.
Figure 2:
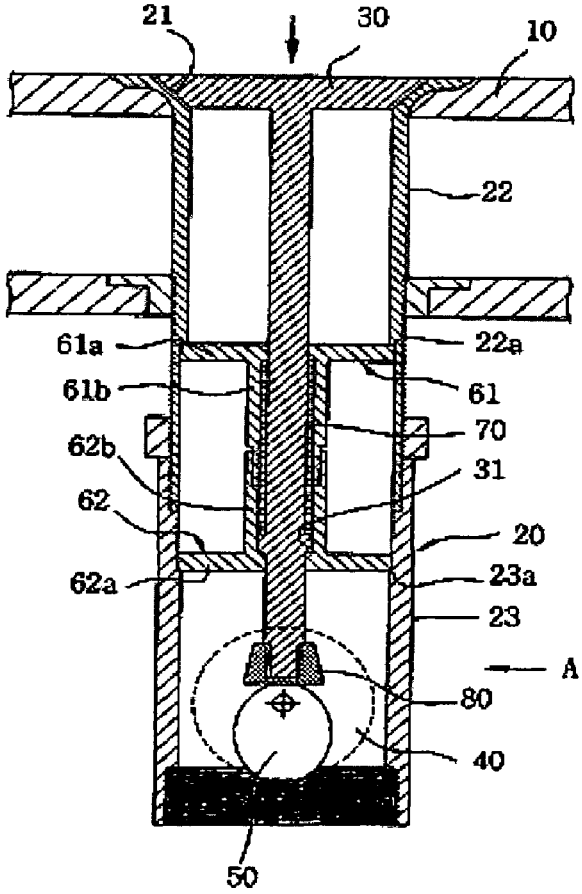
FIG. 2 is a view illustrating the construction of an apparatus for automatically opening and shutting a drain valve, wherein the valve is shut, according to an embodiment of the present invention.
Figure 3:
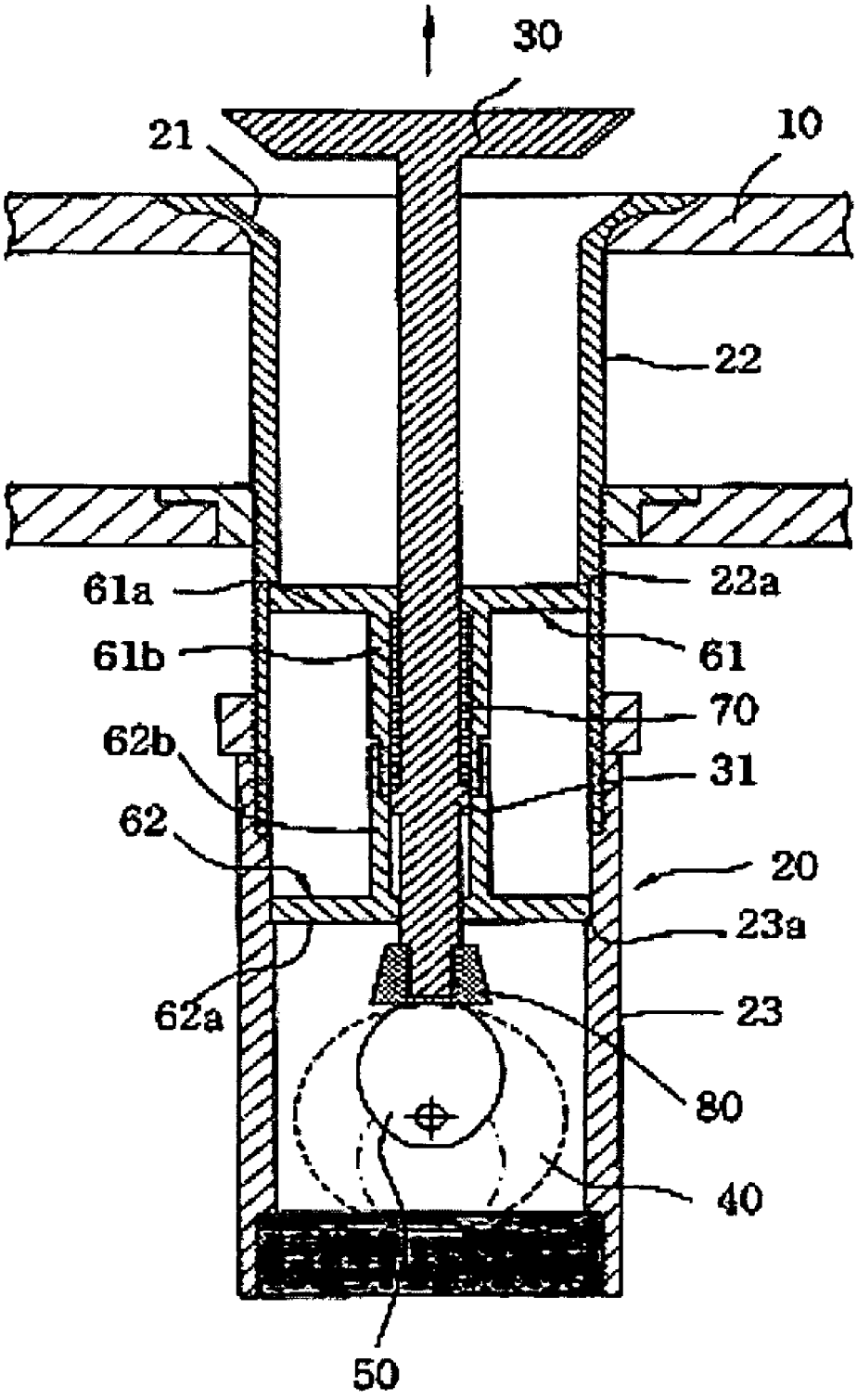
FIG. 3 is a view illustrating the construction of an apparatus for automatically opening and shutting a drain valve, wherein the valve is opened, according to an embodiment of the present invention.
Figure 4:
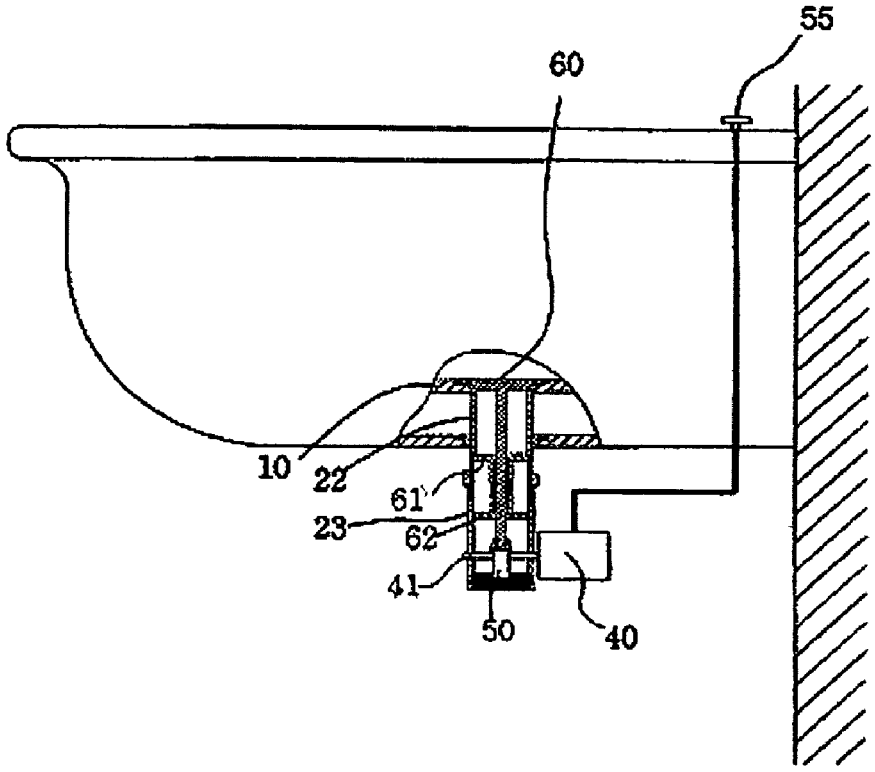
FIG. 4 is a view illustrating the apparatus for automatically opening and shutting the drain valve, which is seen from "A" in FIG. 2.
Figure 5:
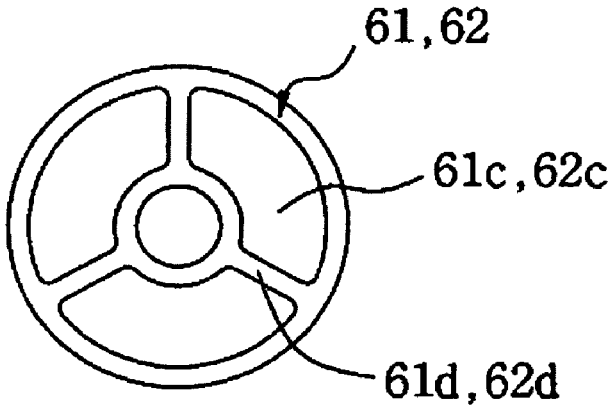
FIG. 5 is a plane view of a spring housing.

A mechanism for automatically opening and shutting a drain valve of a washstand will be describe in detail with reference to FIG. 2 to FIG. 5.

Referring to FIG. 2 to FIG. 5, the apparatus for automatically opening and shutting the drain valve includes a drain-pipe 20 connected to the bottom of a washstand 10, a drain-outlet 21 that is shut and opened by a drain valve 30 built in the drain-pipe, a deceleration motor 40 that is mounted or one side of the drain-pipe 20 and rotates at a low speed, and a working cam 50 contacting the bottom of the washstand drain valve 30 on the deceleration motor 40.

At this time, a touch button 55 or a lever type button for turning on/off the deceleration motor 40, which is electrically connected to the deceleration motor 40, is formed at a predetermined portion (preferably a position where a user's hands can touch) of the washstand 10.

Furthermore, the drainpipe 20 is divided into an upper drainpipe 22 and a lower drainpipe 23, which are integrally combined by a screw. The drain valve 30 is disposed within the combined body in an upright position.

An upper spring housing 61 and a lower spring housing 62 are installed within the upper drainpipe 22 and the lower drainpipe 23, respectively, in an opposite manner each other. The upper spring housing 61 and the lower spring housing 62 are integrally combined by a screw. At this time, latching jaws 22*a* and 23*a* for preventing the upper spring housing 61 and the lower spring housing 62 from fluctuating up and down are disposed within the upper drainpipe 22 and the lower drainpipe 23, respectively.

Furthermore, the upper spring housing 61 and the lower spring housing 62 include latching plates 61*a* and 62*a* and spring support units 61*b* and 62*b* that are integrally formed at their centers, respectively. In the above, the latching plates 61*a* and 62*a* are formed so that drain-holes 61*c* and 62*c* are divided by a plurality of ribs 61*d* and 62*d* so that drainage is possible.

In addition, a spring 70 for resiliently supporting the drain valve 30 in a working direction is disposed within the upper spring housing 61 and the lower spring housing 62, i.e., within the spring support units 61*b* and 62*b*.

Also an annular latch unit 31 disposed at the center of the lower spring housing 62 is formed in the washstand drain valve 30. The annular latch unit 31 functions to push up the spring 70 when the drain valve rises. It also serves a descending limited jaw for preventing the drain valve from going down to a predetermined position.

An unexplained reference numeral 80 designates a cam support plate for facilitating a surface contact with the working cam 50.

The operation of the apparatus constructed above will be described.

In a state where the apparatus for automatically opening and shutting the drain valve is coupled to the washstand, if a user pushes the touch button 55 disposed at a predetermined position of the washstand 10, the power is applied to the deceleration motor 40 and the working cam 50 is simultaneously rotated 180°. By means of the turning radius of the working cam, the washstand drain valve 30 surpasses the force of the spring 70 to vertically rise, thereby opening the drain-outlet 21.

On the contrary, if the user pushes the touch button 55 again, the power is applied to the deceleration motor 40 and the working cam 50 is simultaneously rotated 180°. By means of the turning radius of the working cam, the washstand drain valve 30 vertically descends to shut the drain-outlet 21. At this time, as the spring 70 downwardly pushes the annular latch unit 31 of the washstand drain valve 30 by its elastic force, so that the washstand drain valve tightly seals the drain-outlet 21.

As described above, the present invention has an effect that it can provides easy manipulation of a washstand compared to conventional manual manipulation since a drain valve is automatically opened and shut by simple touch manipulation.

Furthermore, it is possible to simplify the manufacturing process of a washstand since the process of forming a through-hole where a working rod is disposed is not necessary is obviated.

In addition, as a working rod is not protruded outside of a washstand, there is no danger of an injury or a wound due to the protruded working rod.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. An apparatus for opening, and closing a drain valve in a washstand having a hole to which a drain-pipe is connected, the apparatus comprising:

the drain valve having a cap for preventing liquid flow through the hole into the drainpipe and an elongated rod having a first end connected to the cap and a second end disposed inside the drainpipe, a motor having a motor shaft formed outside the drainpipe;

a circular cam contacting the second end of the elongated rod of the drain valve inside the drain pipe and being connected to the motor shaft through the drainpipe, wherein the cam is mounted inside the drainpipe to come in contact with the liquid flowing through the drainpipe, and wherein the cam is driven by the motor to rotate to exert axial force on the second end of the elongated rod by which the elongated rod is actuated opposite the bias force to move the cap to a plurality of predetermined positions with respect to the hole of the washstand a switch for initiating the movement of the cap to a plurality of predetermined positions with respect to the hole of the washstand;

a spring for providing a bias force on the elongated rod so that the cap is actuated to fit into the hole to close the drain valve when the switch is in the off state;

a upper spring housing; and a lower spring housing, wherein the upper spring housing and the lower spring housing are fitted together to form an inner cylindrical opening and an outer cylindrical opening, wherein the fitted inner and lower spring housing are mounted inside the drainpipe such that the outer cylindrical opening allows liquid flow therethrough, wherein the inner cylindrical opening receives a portion of the elongated rod and the spring wrapping around the portion of the elongated rod inside the inner cylindrical opening, and wherein the spring is housed inside the inner cylindrical opening to exert force on the elongated rod by which the cap of the drain valve is closed during the off state.

2. The apparatus for opening and closing a drain vale in a washstand as claimed in claim 1, wherein the switch has a on or off state.

3. The apparatus for opening and closing a drain valve in a washstand as claimed in claim 2, such that, when the switch is set to the on state, the cam is actuated by the motor such that the cap is moved away from the hole to open the drain valve.

4. The apparatus for opening and closing a drain valve in a washstand as claimed in claim 3, further comprising a cam support plate connected to the second end of the elongate rod and in contact with the cam.

* * * * *